US010787009B2

(12) United States Patent
Kozuma et al.

(10) Patent No.: US 10,787,009 B2
(45) Date of Patent: Sep. 29, 2020

(54) PRINTING APPARATUS

(71) Applicant: SEIKO EPSON CORPORATION, Tokyo (JP)

(72) Inventors: Itaru Kozuma, Matsumoto (JP); Toshiaki Ishikawa, Matsumoto (JP); Tae Kojima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/529,423

(22) Filed: Aug. 1, 2019

(65) Prior Publication Data

US 2020/0039255 A1 Feb. 6, 2020

(30) Foreign Application Priority Data

Aug. 2, 2018 (JP) ..... 2018-145668

(51) Int. Cl.
*B41J 13/00* (2006.01)
*B41J 15/04* (2006.01)

(52) U.S. Cl.
CPC ..... *B41J 13/0009* (2013.01); *B41J 15/048* (2013.01)

(58) Field of Classification Search
CPC .. B41J 13/0009; B41J 15/048; B41J 11/0095; B41J 11/42; B41J 15/04; B41J 11/70; B41J 2/01; B41J 15/00
See application file for complete search history.

(56) References Cited

U.S. PATENT DOCUMENTS

2012/0042760 A1* 2/2012 Mitsuhashi ..... B41J 11/46 83/72

FOREIGN PATENT DOCUMENTS

JP 2012-176821 9/2012

OTHER PUBLICATIONS

IP.com search (Year: 2020).*

* cited by examiner

*Primary Examiner* — Lisa Solomon
(74) *Attorney, Agent, or Firm* — Workman Nydegger

(57) ABSTRACT

A printing apparatus includes a first roller pair that sandwiches and conveys a continuous medium, a printing head that is located downstream of the first roller pair in a conveying direction of the continuous medium and that performs printing on the continuous medium, a cutting unit that is located downstream of the printing head in the conveying direction of the continuous medium and that cuts the continuous medium, a second roller pair that is located downstream of the cutting unit in the conveying direction of the continuous medium and that sandwiches and conveys the continuous medium, a common driving source that applies driving force to the first roller pair and the second roller pair, and a clutch mechanism configured to cut power from the driving source to the second roller pair, wherein the clutch mechanism is an electromagnetic mechanism that releases transmission of the power by electromagnetism.

2 Claims, 7 Drawing Sheets

PRINTING APPARATUS

The present application is based on, and claims priority from JP Application Serial Number 2018-145668, filed Aug. 2, 2018, the disclosure of which is hereby incorporated by reference herein in its entirety.

BACKGROUND

1. Technical Field

The present disclosure relates to a printing apparatus.

2. Related Art

Typically, a recording device provided with a sheet storage mechanism that stores a sheet discharged from a discharge port is known (for example, see JP-A-2012-176821).

However, in the recording device described above, there is a problem that, when the sheet is stored in the sheet storage mechanism in a state where a portion of the sheet on which an image is formed is not sufficiently dried, due to a deformation of the sheet or the like, the portion of the sheet on which the image is formed is rubbed and the image quality is decreased.

SUMMARY

The printing apparatus according to the present application includes a first roller pair configured to sandwich and convey a continuous medium, a printing head that is located downstream of the first roller pair in a conveying direction of the continuous medium and that is configured to perform printing on the continuous medium, a cutting unit that is located downstream of the printing head in the conveying direction of the continuous medium and that is configured to cut the continuous medium, a second roller pair that is located downstream of the cutting unit in the conveying direction of the continuous medium and that is configured to sandwich and convey the continuous medium, a common driving source configured to apply driving force to the first roller pair and the second roller pair, and a clutch mechanism configured to cut power from the driving source to the second roller pair, wherein the clutch mechanism is an electromagnetic mechanism that releases transmission of the power by electromagnetism.

The printing apparatus described above may further include a medium detector that is located between the first roller pair and the printing head and that is configured to detect presence or absence of the continuous medium, and a control unit that is configured to, after the continuous medium is cut, convey, in a reverse direction, the continuous medium located at a supply side, and that is configured to, after an end portion at the downstream side of the continuous medium is detected by the medium detector, convey the continuous medium in a forward direction and temporarily stop the continuous medium at a predetermined position. The control unit controls the clutch mechanism to, when the continuous medium is conveyed in the reverse direction, cut the power from the driving source to the second roller pair and, when the continuous medium is conveyed in the forward direction after being temporarily stopped at the predetermined position, couple the power from the driving source to the second roller pair, and then, when a distance between the second roller pair and an end portion at the upstream side in the conveying direction of the continuous medium that is sandwiched by the second roller pair is 2 mm±1 mm, cut the power from the driving source to the second roller pair.

DESCRIPTION OF EXEMPLARY EMBODIMENTS

Hereinafter, embodiments of the present disclosure will be described below with reference to the figures. Note that, in each of the figures below, to illustrate each of members and the like in a recognizable size, each of the members and the like is illustrated to a scale different from an actual scale.

Figure 1:
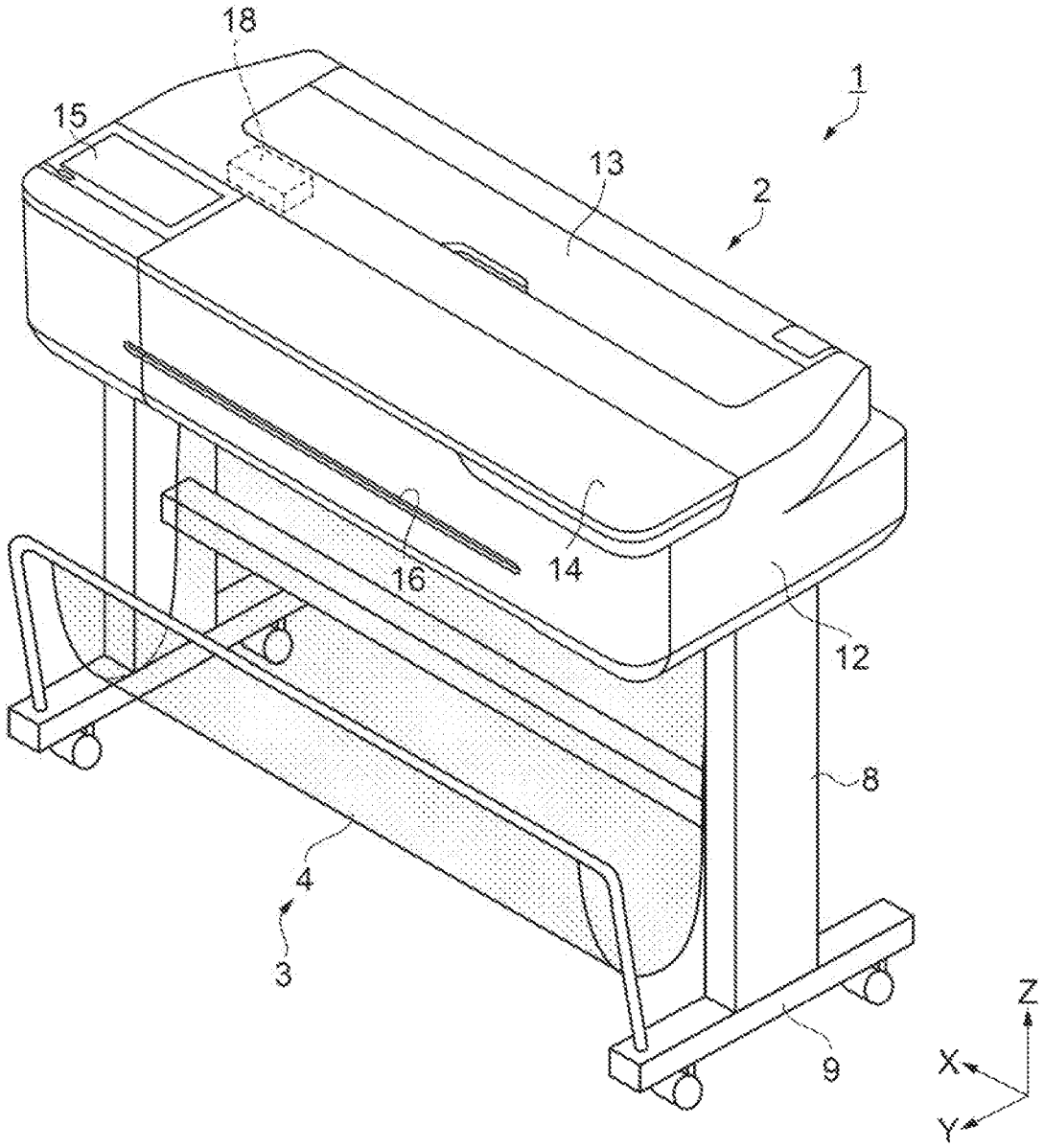
FIG. 1 is a perspective view illustrating a configuration of a printing apparatus.

First, a configuration of a printing apparatus 1 will be described. FIG. 1 is a perspective view illustrating the configuration of the printing apparatus 1. Note that in the following description, assuming that the printing apparatus 1 illustrated in FIG. 1 is placed on a horizontal surface, a direction along the upward and downward directions (vertical direction) is illustrated as a Z axis direction, and a direction along the horizontal surface is illustrated as an X axis direction and a Y axis direction. That is, when the printing apparatus 1 is viewed from the front, the X axis direction that is the width direction, the Y axis direction that is the depth direction, and the Z axis direction that is the height direction are different directions and are orthogonal to each other.

As illustrated in FIG. 1, for example, the printing apparatus 1 is an ink jet printer capable of forming an image with respect to a sheet S (roll paper) as a continuous medium with a relatively large size, such as an A0 size or B0 size of the JIS standard. The printing apparatus 1 includes a main body 2 and a discharged sheet receiving unit 3. The main body 2 is disposed on the upper portion of a prop 8 that is erected on a base 9. The discharged sheet receiving unit 3 has a stacker 4. The stacker 4 is disposed below the main body 2 and receives the sheet S discharged from the main body 2 side.

The printing apparatus 1 includes a substantially rectangular parallelepiped housing 12. On the top surface of the housing 12, a sheet feed cover 13 located on the rear side and a maintenance cover 14 located on the front side are provided to be openable and closable. An operation panel 15 for performing various operations of the printing apparatus 1 is disposed at a position adjacent to the maintenance cover 14 in the X axis direction on the upper surface of the housing 12. Then, a discharge port 16 that allows discharging of the sheet S on which the image is formed in the housing 12 is disposed on the front surface of the housing 12 on the +Y direction side in the Y axis direction. In the present embodiment, the +Y direction in the Y axis direction coincides with the discharge direction of the sheet S.

Figure 2:
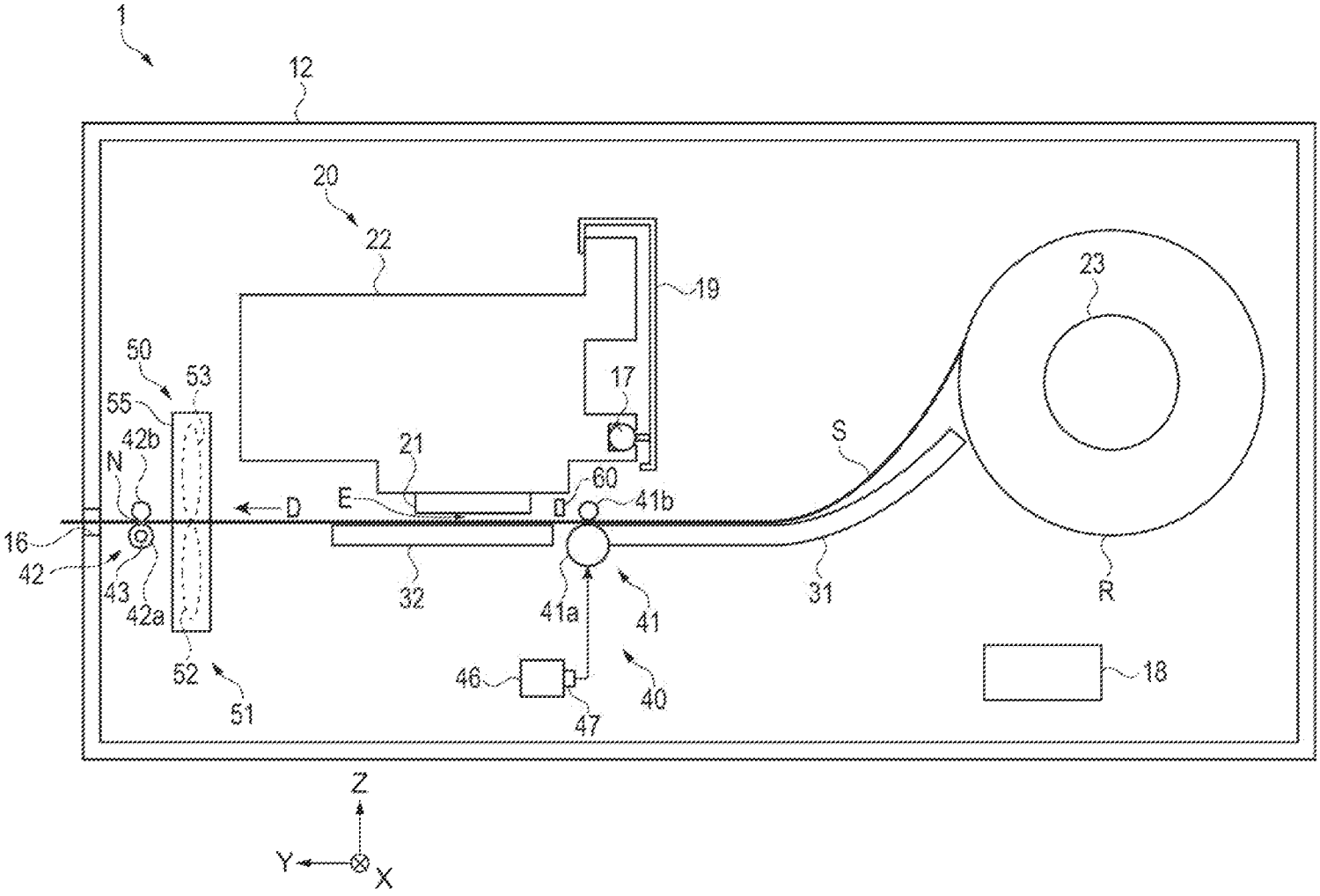
FIG. 2 is a schematic view illustrating the configuration of the printing apparatus.

FIG. 2 is a schematic view illustrating the configuration of the printing apparatus 1. As illustrated in FIG. 2, the housing 12 of the printing apparatus 1 includes a recording unit 20 that records an image of character, photographs, and the like on the sheet S, and a first support member 31 and a second support member 32 that support the sheet S. In addition, the housing 12 of the printing apparatus 1 includes a conveying unit 40 that conveys the sheet S, and a cutting unit 50 that cuts the sheet S recorded by the recording unit 20. Then, a control unit 18 that controls each of the components of the printing apparatus 1 is provided.

A roll body R in which the sheet S is wound in a roll shape is disposed in the housing 12. The roll body R is disposed rearward in the housing 12 in FIG. 2. The roll body R is rotatably supported by a shaft 23 provided to extend in the width direction (X axis direction) of the sheet S. According to the present embodiment, the sheet S is conveyed out from the roll body R by rotating the shaft 23 in the counterclockwise direction in FIG. 2. The conveyed out sheet S is conveyed by the conveying unit 40 and is discharged from the housing 12 to the outside of the housing 12 through the discharge port 16 that opens to the front surface of the housing 12. That is, according to the present embodiment, a direction from the rear to the front of the housing 12 is a conveying direction D of the sheet S conveyed by the conveying unit 40.

The recording unit 20 includes a printing head 21 (for example, an ink jet head) that ejects ink as a liquid toward the sheet S and prints on the sheet S, and a carriage 22 on which the printing head 21 is mounted. The carriage 22 is supported by a frame 19 disposed in the housing 12 and a guide shaft 17 attached to the frame 19. The guide shaft 17 extends in the width direction (X axis direction) of the sheet S. The carriage 22 is movable along the guide shaft 17 by the power of a motor (not illustrated). That is, the carriage 22 reciprocates in a direction (X axis direction) that intersects the conveying direction D of the sheet S. The printing head 21 can eject ink on the sheet S across the X axis direction (width direction) by moving the carriage 22 along the guide shaft 17.

The first and second support members 31 and 32 are configured by plate-shaped members. The first support member 31 is disposed upstream of the second support member 32 in the conveying direction D of the sheet S, and guides the sheet S conveyed out from the roll body R toward the recording unit 20. The second support member 32 is disposed to face the printing head 21 of the recording unit 20. At the ejected position E where the second support member 32 and the printing head 21 face each other, ink is ejected from the printing head 21 onto the sheet S.

The conveying unit 40 conveys the sheet S conveyed out from the roll body R toward the discharge port 16 from within the housing 12 along the first and second support members 31 and 32 while sandwiching the sheet S. In the conveying unit 40 of the present embodiment, a first roller pair 41 is disposed on the most upstream side in the conveying direction D, and the second roller pair 42 is disposed on the most downstream side in the conveying direction D.

The first roller pair 41 is disposed upstream of the printing head 21 in the conveying direction D and is disposed between the first support member 31 and the second support member 32. The first roller pair 41 sandwiches and conveys the sheet S and includes a first driving roller 41*a* and a driven roller 41*b* which is capable of being driven to rotate with respect to the rotation of the first driving roller 41*a*. The second roller pair 42 includes a second driving roller 42*a* and a driven roller 42*b* which is capable of driven rotation with respect to the rotation of the second driving roller 42*a*.

The first and second driving rollers 41*a* and 42*a* are driven by a motor 46 as a common driving source. In the present embodiment, the first driving roller 41*a* of the first roller pair 41 and the motor 46 are coupled. The first driving roller 41*a* and the second driving roller 42*a* are coupled by a transmission gear. Then, the first and second driving rollers 41*a* and 42*a* are driven to rotate by the driving of the motor 46. As a result, the first and second roller pairs 41 and 42 can rotate in a state in which the sheet S is sandwiched by the first and second driving rollers 41*a* and 42*a* and the driven roller 41*b* and 42*b*, and can convey the sheet S along the conveying direction D. Here, it is conceivable that the driving source (motor) is disposed individually with respect to each of the first and second driving rollers 41*a* and 42*a*, but in this case, there is a risk that the conveying amount of the sheet S is shifted and conveying accuracy is reduced due to the occurrence of dispersion in the conveying accuracy of the first and second driving rollers 41*a* and 42*a*. Therefore, in the present embodiment, the conveying accuracy of the sheet S is improved by driving the first and second driving rollers 41*a* and 42*a* by the common driving source (motor 46).

In addition, a rotary encoder 47 as a measuring means is disposed on the motor 46. The rotary encoder 47 is coupled to the control unit 18. The rotary encoder 47 is a sensor that converts the amount of mechanical displacement of rotation into an electrical signal, and processes the signal to detect position, speed, and the like. According to the embodiment, the rotary encoder 47 is used to position the end portion Sa downstream of the sheet S described below. The rotary encoder 47 is configured by a slit disk fixed to a rotary shaft of the motor 46, and a position detector disposed at a position where the peripheral edge of the slit disk passes. A plurality of position detection slits are formed at equal intervals throughout the entire circumference of the slit disk along the peripheral edge. Then, the position detector includes a light emitting unit configured by a light emitting diode, and a light receiving unit configured by a phototransistor so as to face each other via the peripheral edge of the slit disk. Then, the position detector is configured to output an electrical signal from the light receiving unit when light from the light emitting unit passes through the position detection slit of the slit disk and received by the light receiving unit.

The first and second driving rollers 41*a* and 42*a* are disposed to contact the sheet S from below. The driven roller 41*b* and 42*b* are disposed to contact the sheet S from above. The driven roller 42*b*, when conveying the sheet S, contacts the surface of the sheet S on which the ink is ejected. Therefore, the driven roller 42*b* is configured by a star wheel having a small contact area with respect to the sheet S, or the like in order to reduce deterioration of the quality of the image recorded in the sheet S. Note that the configuration of the driven roller 41*b* is the same as that of the driven roller 42*b*. A plurality of the first and second roller pairs 41 and 42 are disposed at predetermined intervals in the width direction.

The cutting unit 50 is disposed between the printing head 21 and the second roller pair 42 in the conveying direction D. The sheet S cut by the cutting unit 50 is discharged from the discharge port 16 via conveying by the second roller pair 42. Note that the printing apparatus 1 according to the present embodiment is configured with a relatively small interval in the vertical direction Z in the opening of the discharge port 16 so that fingers of a user cannot be inserted into the housing 12 from the discharge port 16. Therefore, by disposing the second roller pair 42 near the upstream side of the discharge port 16, the sheet S can be smoothly conveyed toward the discharge port 16, and sheet jam can be prevented from occurring.

The cutting unit 50 includes a cutting blade 51 for cutting the sheet S and a holding body 55 that holds the cutting blade 51. The cutting blade 51 is configured by a disk-shaped driving blade 52 and a disk-shaped driven blade 53. The driving blade 52 and the driven blade 53 are rotatably attached to the holding body 55. The driving blade 52 and the driven blade 53 are disposed to be aligned in the vertical direction. The holding body 55 is capable of reciprocating along the X axis direction. The cutting unit 50 cuts the sheet S by the cutting blade 51 by moving the holding body 55 along the X axis direction. That is, the sheet S is cut by scanning the cutting unit 50 including the cutting blade 51 in the X axis direction that intersects the conveying direction D of the sheet S.

The cutting unit 50 includes a driving source such as a motor, to reciprocate the cutting unit 50 along the X axis direction by driving force of the motor. Note that the cutting unit 50 and the carriage 22 may be coupled, and the cutting unit 50 may reciprocate along the X axis direction by the power of the motor that moves the carriage 22.

In addition, a medium detector 60 is disposed between the first roller pair 41 and the printing head 21 in the conveying direction D. The medium detector 60 is a sensor that detects the presence of the sheet S. The medium detector 60 is coupled to the control unit 18, and the motor 46 is controlled based on detection data from the medium detector 60. For example, the medium detector 60 is a photo-interrupter, and includes a light emitting unit that emits light and a light receiving unit that receives light emitted from the light emitting unit. For example, as a light emitting element of the light emitting unit, a Light Emitting Diode (LED) light emitting element, a laser light emitting element or the like are applied. In addition, the light receiving unit is configured by a phototransistor, a photo IC and the like. Then, a change in light receiving amount between the light emitting unit and the light receiving unit is converted into an electrical signal and output as detection data. The control unit 18 determines the presence of the sheet S based on the detection data, and controls the motor 46.

Here, a clutch mechanism 43 configured to be able to cut the power from the motor 46 to the second roller pair 42 is disposed on the conveying unit 40. That is, the clutch mechanism 43 is disposed between the motor 46 and the second driving roller 42*a*. The clutch mechanism 43 is an electromagnetic clutch mechanism that can transmit or release the power from the motor 46 to the second driving roller 42*a* by electromagnetism. The clutch mechanism 43 is coupled to the control unit 18. Then, based on a drive signal from the control unit 18, when the clutch mechanism 43 is turned in an ON state, the power is transmitted from the motor 46 to the second driving roller 42*a*. On the other hand, when the clutch mechanism 43 is turned in an OFF state, the power is released from the motor 46 to the second driving roller 42*a*.

In addition, the conveying amount of the sheet S of the first roller pair 41 per predetermined driving amount of the motor 46 is smaller (lower) than the conveying amount of the sheet S of the second roller pair 42. In other words, the second driving roller 42*a* is driven to accelerate with respect to the first driving roller 41*a*. It is possible to drive the speed increasing by adjusting the diameter of the first driving roller 41*a* and the second driving roller 42*a*, gear ratio, and the like. When the printing head 21 ejects ink onto the sheet S to form an image, in a case where the sheet S is extended due to the reception of ink, the sheet S bends and contacts the printing head 21, and an ejection failure of the printing head 21 occurs. Accordingly, by making the conveying amount of the second driving roller 42*a* disposed downstream in the conveying direction D of the second support member 32 including the ejected position E larger than that of the first driving roller 41*a*, tension can be applied to the sheet S, the occurrence of bending of the sheet S can be suppressed, and the occurrence of ejection failure can be prevented.

Figure 3:
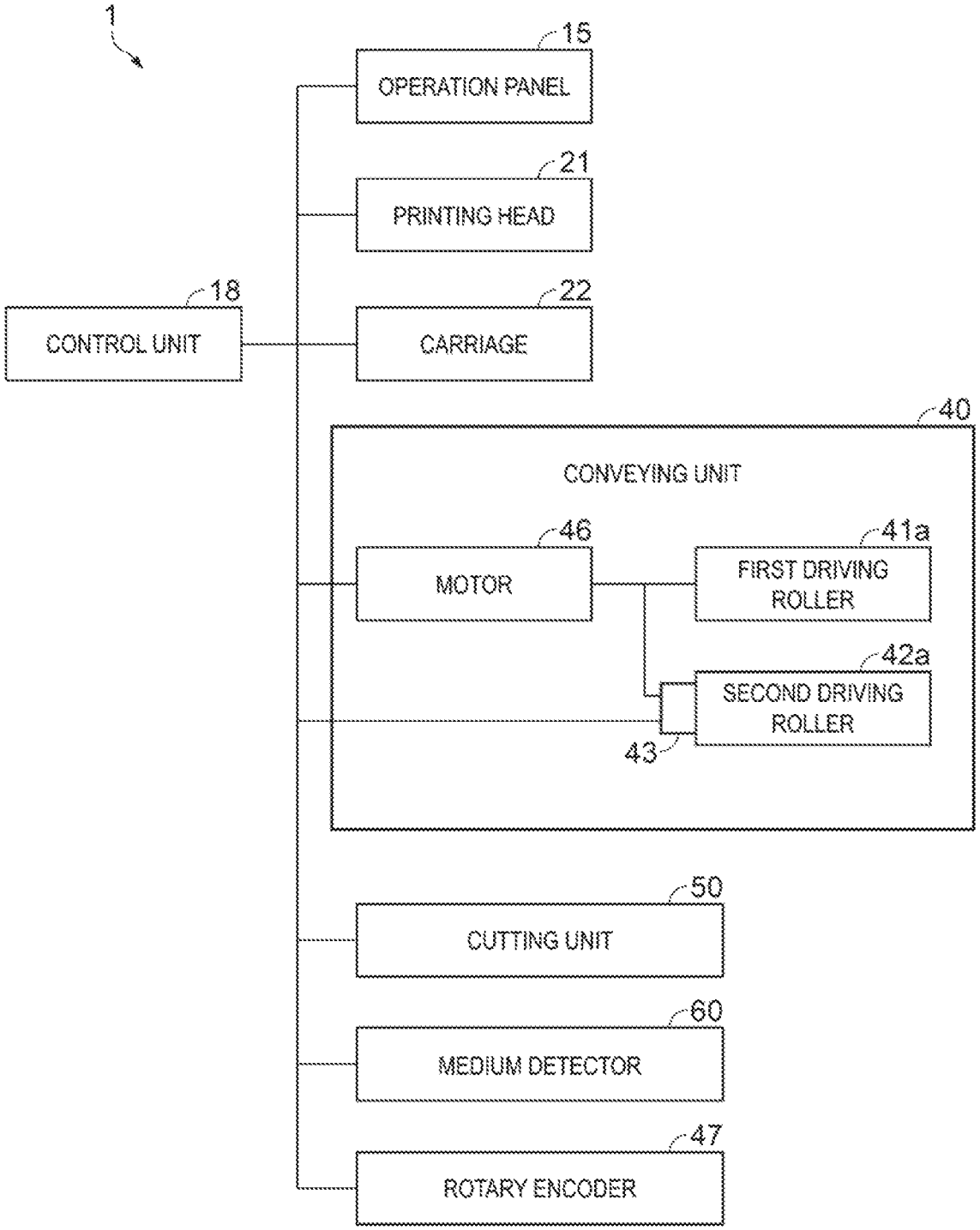
FIG. 3 is a block diagram illustrating a control configuration of the printing apparatus.

Next, the control configuration of the printing apparatus 1 will be described. FIG. 3 is a block diagram illustrating the control configuration of the printing apparatus 1. As illustrated in FIG. 3, the control unit 18 is coupled to the operation panel 15, the printing head 21, the carriage 22, the conveying unit 40, the cutting unit 50, the medium detector 60, and the rotary encoder 47. Further, the control unit 18 is coupled to the clutch mechanism 43. The control unit 18 includes a Central Processing Unit (CPU) for executing various programs, a Random Access Memory (RAM) for temporarily storing data, programs, and the like, a Read Only Memory (ROM) in which various data, various programs, and the like are recorded in advance in a non-volatile manner, and an interface. Then, the CPU processes various signals input via the interface based on data in the RAM and the ROM, and outputs control signals to each unit via the interface. The control unit 18 receives operation information of the user operation from the operation panel 15, controls the carriage 22 (motor), the printing head 21, the motor 46 of the conveying unit 40 and the cutting unit 50 (motor), and executes a printing operation (image forming process) and a cutting operation of the sheet S. In addition, the motor 46 is driven and controlled based on the detection data of the medium detector 60 and the rotary encoder 47. In addition, the clutch mechanism 43 is turned ON/OFF to control the driving of the second driving roller 42*a*.

Next, the control method of the printing apparatus 1 will be described. FIG. 4A to FIG. 4H are schematic views illustrating the control method of the printing apparatus 1. In the control method of the printing apparatus 1 described below, each unit is driven and controlled based on a control signal of the control unit 18.

Figure 4A:
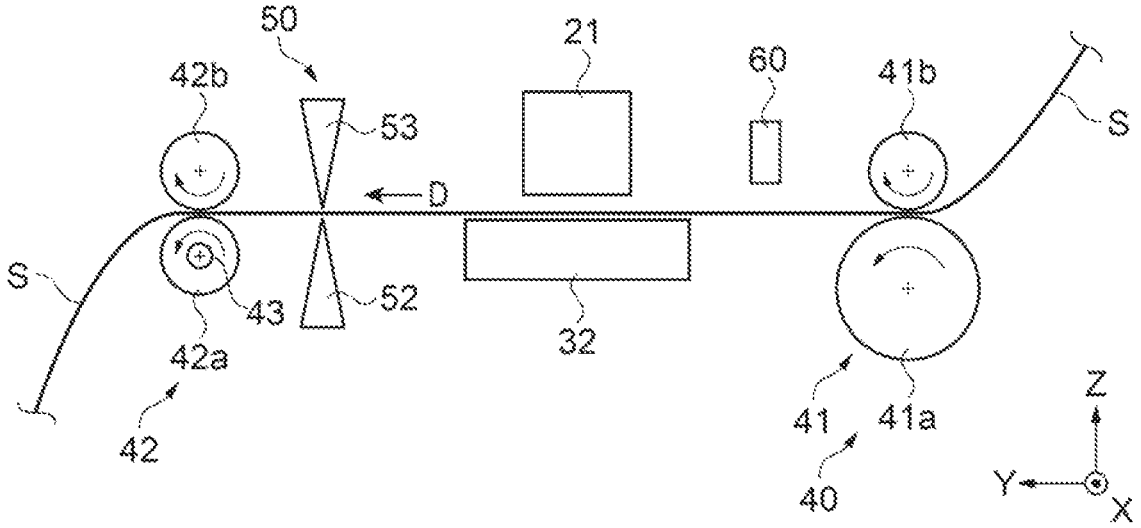
FIG. 4A is a schematic view illustrating a control method of the printing apparatus.

As illustrated in FIG. 4A, the control unit 18 drives the motor 46 of the conveying unit 40 to rotate in a forward direction to intermittently move the sheet S in the conveying direction D. Then, at each stop in the intermittent movement by the conveying unit 40, the carriage 22 is moved in the X axis direction, and ink is ejected from the printing head 21 mounted on the carriage 22 toward the sheet S. As a result, a desired image is printed on the sheet S (image forming process). Note that during the process of image forming, the first and second driving rollers 41*a* and 42*a* are driven to rotate in the counterclockwise direction in FIG. 4A. The sheet S on which the image is formed is conveyed in the conveying direction D by the conveying unit 40, and is discharged from the discharge port 16 (see FIG. 2).

Figure 4B:
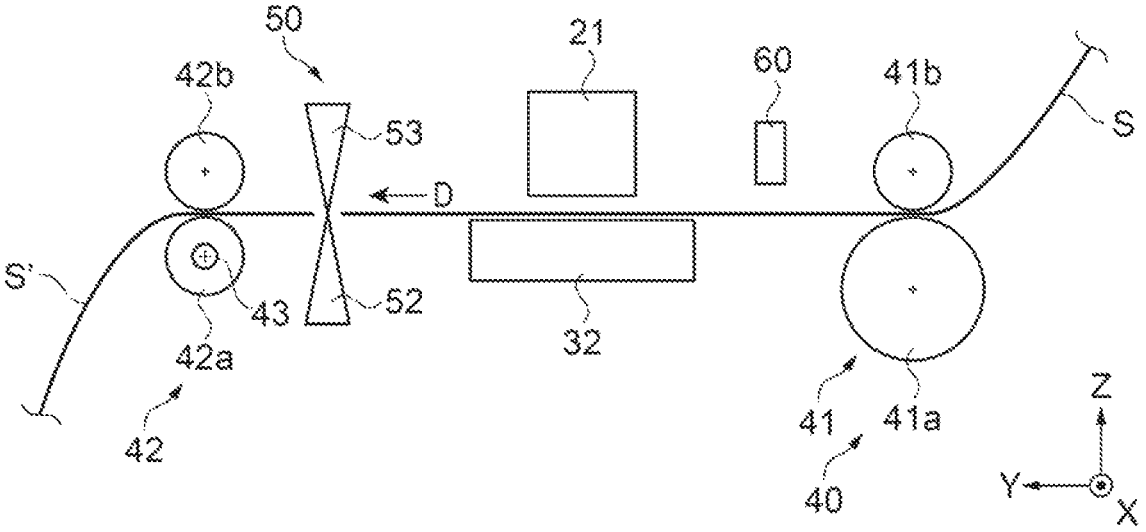
FIG. 4B is a schematic view illustrating the control method of the printing apparatus.

Next, as illustrated in FIG. 4B, after the predetermined recording operation is completed, that is, after the predetermined image is printed on the sheet S, the control unit 18 drives the cutting unit 50 to cut the sheet S. Specifically, the control unit 18 stops the conveying unit 40, and stops the conveying of the sheet S. Thereafter, the control unit 18 moves the cutting unit 50 in the X axis direction. As a result, the sheet S is cut. The sheet S' as a continuous medium cut by the cutting unit 50, is held in a state of being nipped by the second roller pair 42.

Figure 4C:
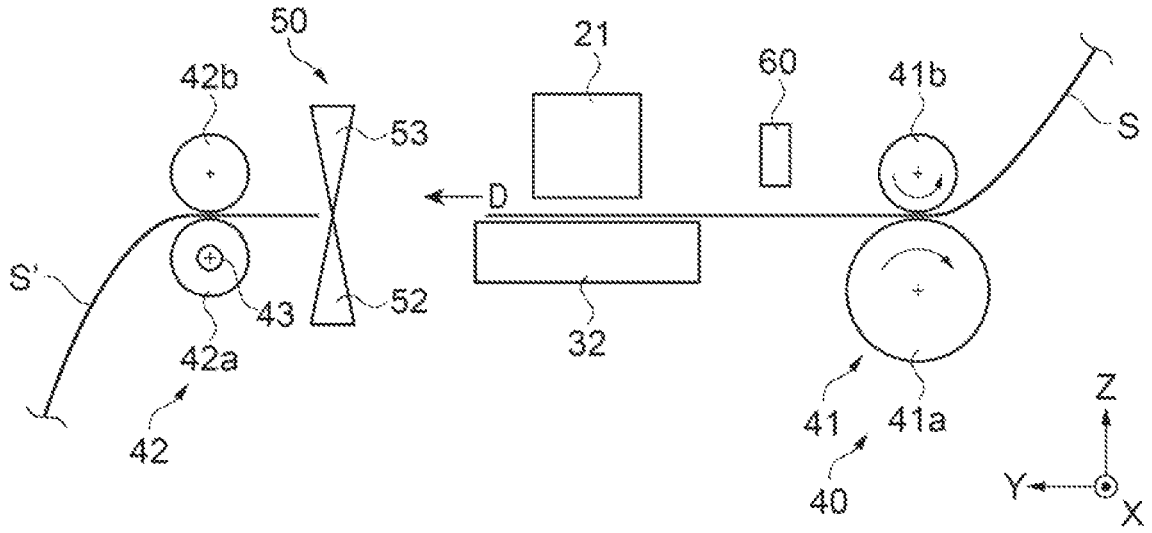
FIG. 4C is a schematic view illustrating the control method of the printing apparatus.

Next, as illustrated in FIG. 4C, the control unit 18 conveys the sheet S located on the supply side (roll body R side) in the reverse direction. That is, the sheet S is conveyed in a direction opposite to the conveying direction D. Specifically, the control unit 18 drives the motor 46 to rotate in the reverse direction opposite to the forward direction. As a result, the first driving roller 41*a* rotates in the clockwise direction in FIG. 4C. Then, the sheet S is conveyed in the direction opposite to the conveying direction D by the first roller pair 41. In addition, when the sheet S on the supply side is conveyed in the reverse direction upstream in the conveying direction D, the control unit 18 cuts the power from the motor 46 to the second roller pair 42. Specifically, the supply of current to the clutch mechanism 43 is stopped based on a control signal of the control unit 18. As a result, the clutch mechanism 43 is turned in the OFF state and the power is released from the motor 46 to the second driving roller 42*a*. Therefore, the second roller pair 42 including the second driving roller 42*a* is held in a state when the sheet S' is cut. That is, the cut sheet S' does not move upstream in the conveying direction D, and the sheet S' does not conflict with the cutting unit 50 and the like. Then, the sheet S' is held by the second roller pair 42, and drying of the ink applied on the sheet S' is promoted.

Figure 4D:
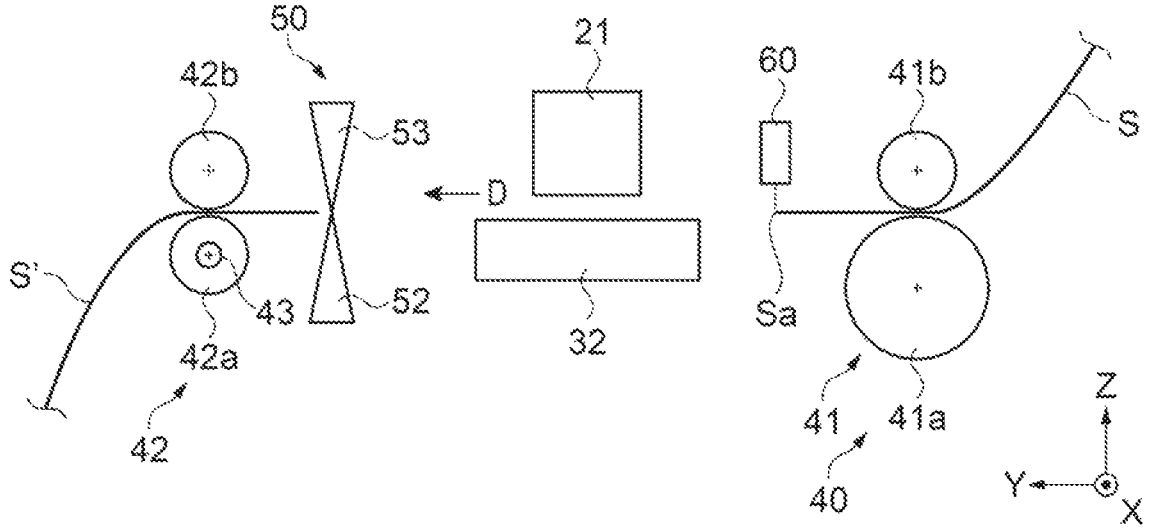
FIG. 4D is a schematic view illustrating the control method of the printing apparatus.

Next, as illustrated in FIG. 4D, the control unit 18 stops the reverse conveying of the sheet S in a case where the end portion Sa on the downstream side of the sheet S conveyed in the reverse direction is detected by the medium detector 60. Specifically, based on the detection data of the medium detector 60, that is, based on the change data of the light receiving amount by the light receiving unit, when the end portion Sa on the downstream side of the sheet S passes through the medium detector 60, the control unit 18 determines that the sheet S is not present, and stops driving the motor 46.

Figure 4E:
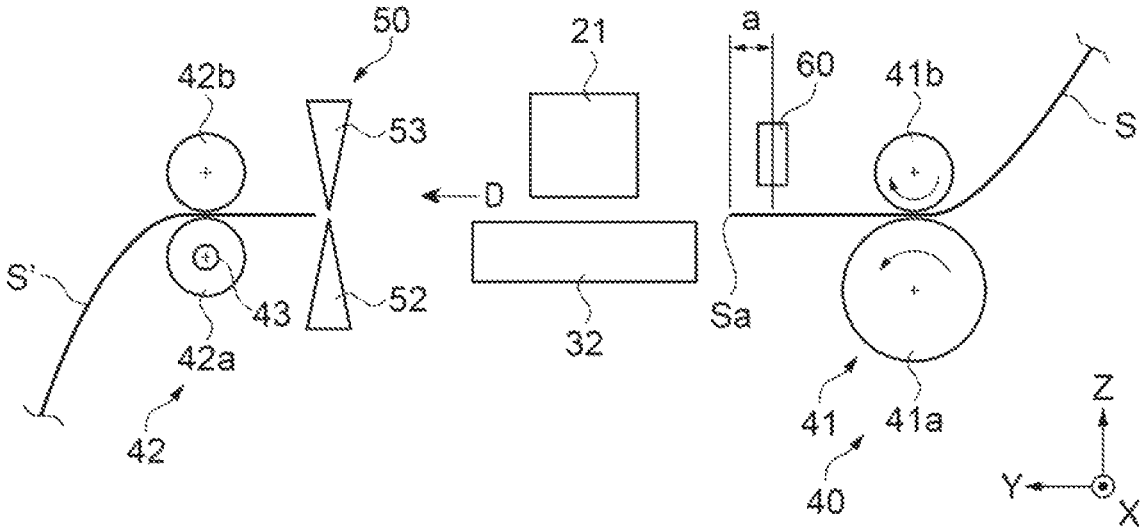
FIG. 4E is a schematic view illustrating the control method of the printing apparatus.

Next, as illustrated in FIG. 4E, the control unit 18 conveys the sheet S in the forward direction (conveys in the conveying direction D), and temporarily stops the end portion Sa on the downstream side of the sheet S at a predetermined position. Specifically, the control unit 18 drives the motor 46 to rotate in the forward direction. As a result, the first driving roller 41*a* rotates in the counterclockwise direction. Then, based on the detection data from the rotary encoder 47, when the end portion Sa on the downstream side of the sheet S reaches the predetermined position, the drive of the motor 46 is stopped. In the control unit 18, the detection data (output value) from the rotary encoder 47 corresponding to a distance from a position where the end portion Sa on the downstream side of the sheet S is detected by the medium detector 60 to the predetermined position is stored in advance. Note that the second roller pair 42 are in a state where the power from the motor 46 is cut off during the processes illustrated in FIG. 4C to FIG. 4E. As a result, the state in which the sheet S' is held by the second roller pair 42 is maintained, and drying of the ink applied on the sheet S' is further promoted.

Figure 4F:
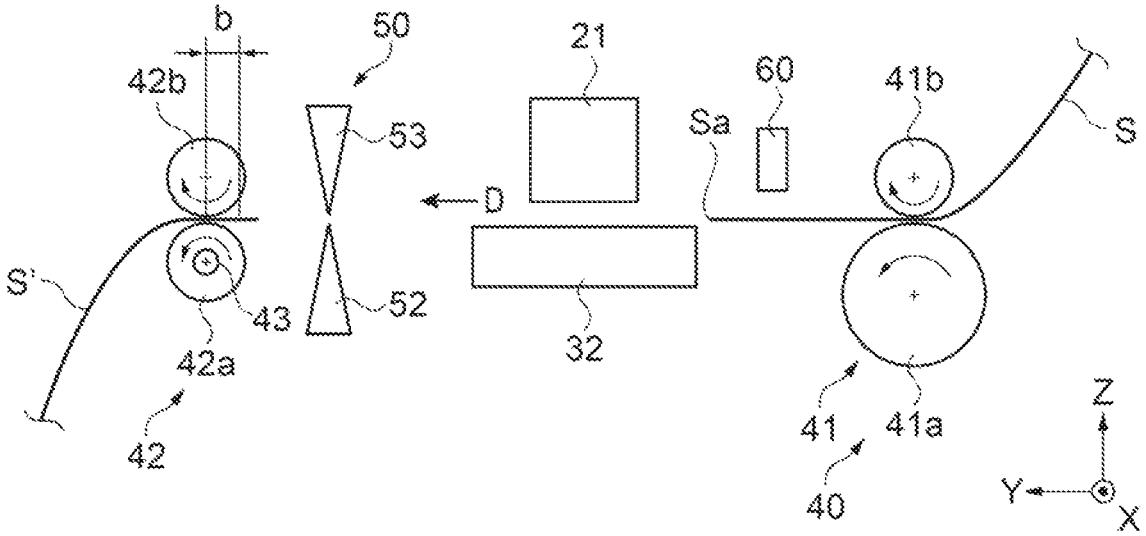
FIG. 4F is a schematic view illustrating the control method of the printing apparatus.

Next, as illustrated in FIG. 4F, the control unit 18 conveys the sheet S and the sheet S' in the forward direction toward the conveying direction D. Specifically, the motor 46 is driven to rotate in the forward direction. As a result, the first driving roller 41*a* rotates in the counterclockwise direction. Then, the sheet S is conveyed in the conveying direction D by the first roller pair 41. In addition, the power from the motor 46 is transmitted to the second roller pair 42. Specifically, current is supplied to the clutch mechanism 43 based on the control signal of the control unit 18. As a result, the clutch mechanism 43 is turned in the ON state and the power is transmitted from the motor 46 to the second drive roller 42*a*, and the second drive roller 42*a* rotates in the counterclockwise direction. As a result, the sheet S' is conveyed in the conveying direction D by the second roller pair 42.

Figure 4G:
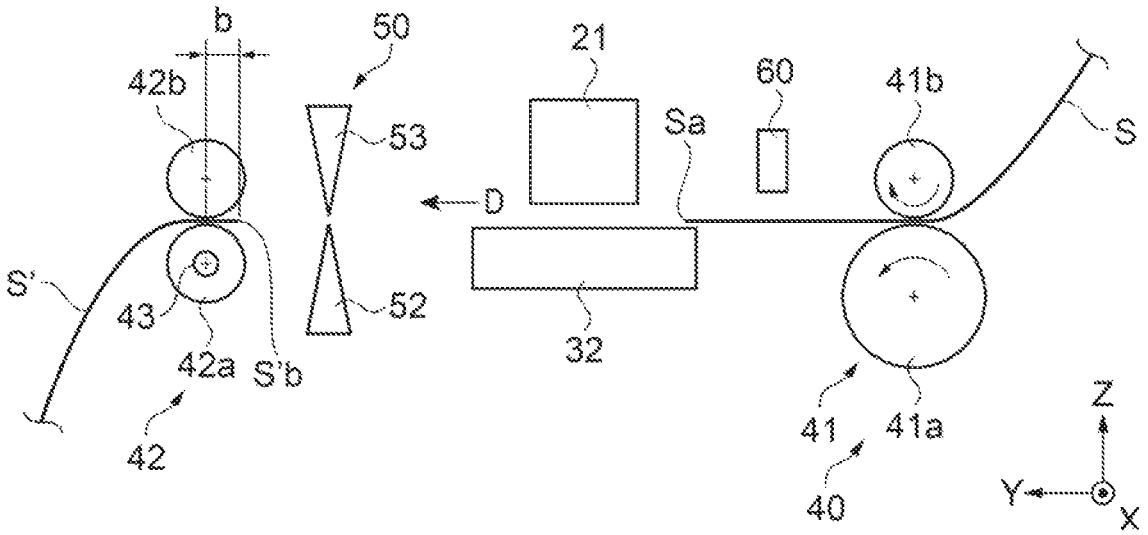
FIG. 4G is a schematic view illustrating the control method of the printing apparatus.

Next, as illustrated in FIG. 4G, the control unit 18 conveys the sheet S and the sheet S' in the forward direction, and cuts (releases) the power from the motor 46 to the second roller pair 42 when the distance between the second roller pair 42 and the end portion S'b on the upstream side in the conveying direction of the sheet S' which is sandwiched by the second roller pair 42 is a predetermined distance b. Note that the predetermined distance b of the present embodiment is 2 mm±1 mm. The control unit 18 drives the motor 46 to rotate in the forward direction and rotates the first driving roller 41*a* in the counterclockwise direction. As a result, the sheet S is conveyed in the conveying direction D by the first roller pair 41.

On the other hand, based on the detection data of the rotary encoder 47 when the end portion S'b on the upstream side in the conveying direction of the sheet S' reached the distance b, the power from the motor 46 to the second roller pair 42 is cut (released). Specifically, the supply of current to the clutch mechanism 43 is stopped based on the control signal of the control unit 18. As a result, the clutch mechanism 43 is turned in the OFF state and the power is released from the motor 46 to the second driving roller 42*a*. Therefore, the second roller pair 42 including the second driving roller 42*a* holds the sheet S' in a state where the distance b between the second roller pair 42 and the end portion S'b on the upstream side in the conveying direction of the sheet S' is 2 mm±1 mm. Specifically, the sheet S' is held in a state where one end portion in the conveying direction D of the sheet S' is held (nipped). Thus, the second roller pair 42 can nip a region other than the region of the sheet S' where the image is formed, and can reduce contact between the driven roller 42*b* of the second roller pair 42 and the image formed on the sheet S' and maintain the image quality. Note that in this state, the user may pull out the sheet S' in the +Y direction. Since the second roller pair 42 nips one end portion of the sheet S', the user can easily pull out the sheet S' without loading from the second roller pair 42.

In the control unit 18, the time when the end portion Sa on the downstream side of the sheet S temporarily stops at the position moving a distance a from the medium detector 60 serves as a base point, and the detection data (output value) from the rotary encoder 47 corresponding to the distance b between the second roller pair 42 and the end portion S'b on the upstream side in the conveying direction of the sheet S' is stored in advance. Note that the distance b can be set as the distance between the end portion S'b on the upstream side in the conveying direction of the sheet S' and the center portion of the nip width in the conveying direction D of the second roller pair 42 when viewed from the Z direction.

Figure 4H:
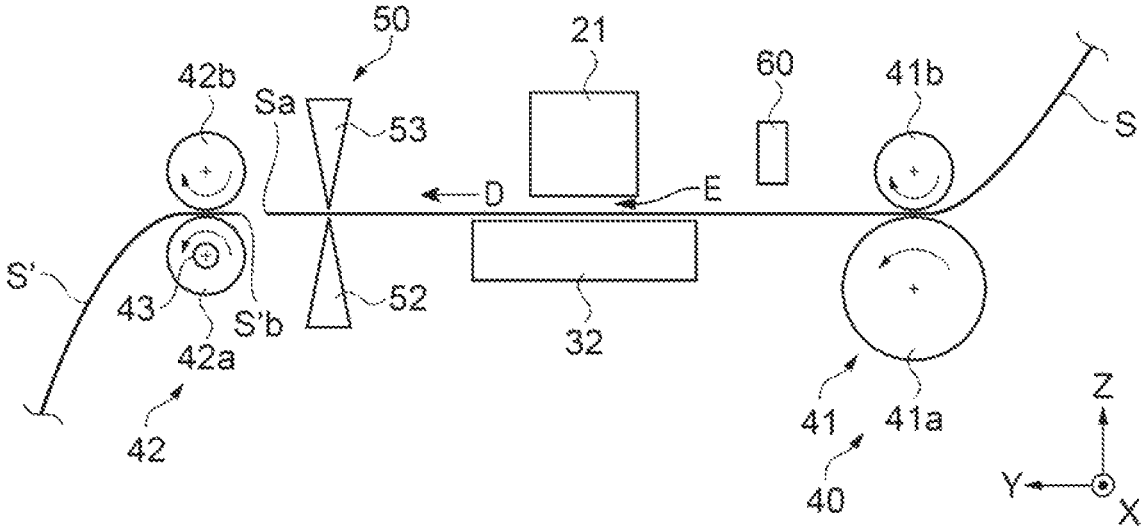
FIG. 4H is a schematic view illustrating the control method of the printing apparatus.

Next, as illustrated in FIG. 4H, the control unit 18 prints an image on the sheet S while conveying the sheet S by the first roller pair 41. Specifically, the motor 46 is driven to rotate in the forward direction. As a result, the first driving roller 41*a* rotates in the counterclockwise direction. The sheet S is further conveyed in the conveying direction D In addition, the carriage 22 and the printing head 21 are driven, and ink is ejected from the printing head 21 to the sheet S at the ejected position E. As a result, an image is printed on the sheet S.

On the other hand, when the sheet S is conveyed in the conveying direction D and the end portion Sa on the downstream side of the sheet S reached the determined position, the control unit 18 conveys the sheet S' in the conveying direction D by the second roller pair 42. Here, the predetermined position is a position in which the end portion Sa on the downstream side of the sheet S and the end portion S'b on the upstream side of the sheet S' are close to each other when viewed from the Z direction. For example, the predetermined position is the position in which the end portion Sa on the downstream side of the sheet S reached the intermediate position between the cutting unit 50 and the second roller pair 42. More specifically, the predetermined position is the intermediate position between the end portion in +Z direction of the driving blade 52 of the cutting unit 50 and the center portion of the nip width in the conveying direction D of the second roller pair 42 when viewed from the Z direction.

At the predetermined position, in the control unit 18, the time when the end portion Sa on the downstream side of the sheet S temporarily stops at the position moving a distance a from the medium detector 60 serves as a base point, and the detection data (output value) from the rotary encoder 47 corresponding to the position where the end portion Sa on the downstream side reached the intermediate position between the cutting unit 50 and the second roller pair 42 is stored in advance. Then, current is supplied to the clutch mechanism 43 based on the control signal of the control unit 18. As a result, the clutch mechanism 43 is turned in the ON state and the power is transmitted from the motor 46 to the second drive roller 42*a*. The second driving roller 42*a* rotates in a counterclockwise direction. The sheet S' is conveyed in the conveying direction D. Then, when the sheet S' is removed from the nip position of the second roller pair 42, the sheet S' falls and is stored in the stacker 4.

That is, the sheet S' is maintained in a state where the sheet S' is nipped by the second roller pair 42 until the end portion Sa on the downstream side of the sheet S moves near the end portion S'b on the upstream side of the sheet S'. As a result, it is possible to ensure a longer time for drying the image printed on the sheet S'. Hereinafter, FIG. 4A to FIG. 4H are repeated.

According to the present embodiments, the following advantages can be obtained.

The sheet S on which the image is printed by the printing head 21 is conveyed in the conveying direction D by driving the first roller pair 41 and the second roller pair 42. Thereafter, the sheet S conveyed in the conveying direction D is cut by the cutting unit 50. Here, the sheet S on the supply side is conveyed in the reverse direction in the direction opposite to the conveying direction D for the next printing process. In this case, the sheet S is moved to the upstream side in the conveying direction D by driven the first roller pair 41 to rotate in the reverse direction (the clockwise direction in FIG. 4C). At this time, the transmission of the power of the second roller pair 42 is released by the electromagnetic clutch mechanism 43. That is, the second roller pair 42 is held in a state where the cut sheet S' is sandwiched (nipped) without rotating. As a result, sheet jam and the like can be prevented without the cut sheet S' conflicting with the cutting unit 50. In addition, drying of the image printing portion can be promoted in a state in which the sheet S' is sandwiched by the second roller pair 42.

In addition, after the sheet S on the supply side is detected by the medium detector 60, the sheet S is conveyed in the forward direction toward the conveying direction D by the driving of the first roller pair 41, and temporarily stopped at a predetermined position. At this time, the power is transmitted to the second roller pair 42, and the cut sheet S' is conveyed in the conveying direction D. Then, when the distance between the second roller pair 42 and the end portion S'b on the upstream side in the conveying direction D of the cut sheet S' is 2 mm±1 mm, the power to the second roller pair 42 is released by the clutch mechanism 43. As a result, the second roller pair 42 is held in a state in which one end portion of the sheet S' is held (nipped) in the conveying direction D. Thus, the second roller pair 42 can nip a region other than the region of the sheet S' where the image is formed, since the contact between the second roller pair 42 and the image formed on the sheet S' is reduced, the image quality can be maintained. In addition, since the second roller pair 42 nip one end portion of the sheet S', the user can easily pull out the sheet S' in the +Y direction without loading from the second roller pair 42.

Note that, the disclosure is not limited to the above-described exemplary embodiment, and various changes and improvements can be made to the above-described exemplary embodiment. Such modified examples are described below.

(Modified Example 1) In the above-described embodiment, as illustrated in FIG. 4G, the rotary encoder 47 detected the distance b between the second roller pair 42 and the end portion S'b on the upstream side of the sheet S' sandwiching by the second roller pair 42 in the conveying direction D by the second roller pair 42, but it is not limited to this, for example, a light sensor such as a photo-interrupter may be disposed between the cutting unit 50 and the second roller pair 42, which serves as the conveying path for the sheet S, and the distance b may be detected by the photo-interrupter. In addition, in the same manner as in FIG. 4H, a predetermined position of the end portion Sa on the downstream side of the sheet S is detected by the rotary encoder 47, but regardless of this, it may be detected by a photo-interrupter or the like in the same manner described above. Even with this configuration, similar advantages as described above can be obtained.

Contents derived from the embodiments will be described below.

The printing apparatus includes a first roller pair that sandwiches and sending conveys a continuous medium, a printing head that is located downstream of the first roller pair in a conveying direction of the continuous medium and that performs printing on the continuous medium, a cutting unit that is located downstream of the printing head in the conveying direction of the continuous medium and that cuts the continuous medium, a second roller pair that is located downstream of the cutting unit in the conveying direction of the continuous medium and that sandwiches and conveys the continuous medium, a common driving source that applies driving force to the first roller pair and the second roller pair, and a clutch mechanism configured to cut power from the driving source to the second roller pair, wherein the clutch mechanism is an electromagnetic mechanism that releases transmission of the power by electromagnetism.

According to this configuration, the continuous medium on which the image is printed by the printing head is conveyed in the conveying direction by driving the first roller pair and the second roller pair. The continuous medium conveyed in the conveying direction is cut by the cutting unit. Here, the continuous medium on the upstream side in the conveying direction of the cutting unit may be pulled back to a predetermined position in preparation for the next printing process. In this case, the first roller pair is driven in reverse rotation, and the continuous medium is moved in a direction opposite to the conveying direction. At this time, the power to the second roller pair can be released by the electromagnetic clutch mechanism. As a result, the second roller pair can remain in a state where the cut continuous medium is held (nipped) without rotating. Thus, the drying time after image printing of the cut continuous medium is ensured, and drying of the image printing portion can be promoted.

The printing apparatus described above may further includes a medium detector that is located between the first roller pair and the printing head and that detects the presence or absence of the continuous medium, and a control unit that, after the continuous medium is cut, conveys the continuous medium located on a supply side in a reverse direction, and that, after an end portion on the downstream side of the continuous medium is detected by the medium detector, conveys the continuous medium in a forward direction and temporarily stops the continuous medium at a predetermined position, wherein the control unit controls the clutch mechanism to, when the continuous medium is conveyed in the reverse direction, cut the power from the driving source to the second roller pair, and when the continuous medium is conveyed in the forward direction after being temporarily stopped at the predetermined position, couple the power from the driving source to the second roller pair, and then, when the distance between the second roller pair and an end portion on the upstream side in the conveying direction of the continuous medium that is sandwiched by the second roller pair is 2 mm±1 mm, cut the power from the driving source to the second roller pair.

According to this configuration, when the continuous medium is cut, the continuous medium on the supply side is conveyed in the reverse direction which is the reverse direction of the conveying direction for the next printing process. Note that, at this time, the transmission of the power to the second roller pair is released by the clutch mechanism, and the cut continuous medium is held in a state of sandwiching by the second roller pair. Thereafter, after the continuous medium on the supply side is detected by the medium detector, the continuous medium is conveyed in the forward direction in the conveying direction by the driving of the first roller pair, and temporarily stopped at the predetermined position. Thereafter, the continuous medium is conveyed in the forward direction in the conveying direction. At this time, the second roller pair is also driven by the power of the driving source, and the cut continuous medium is conveyed downstream in the conveying direction. Then, when the distance between the second roller pair and the end portion on the upstream side in the conveying direction of the cut continuous medium is 2 mm±1 mm, the power of the second roller pair is released by the electromagnetic clutch mechanism. As a result, the second roller pair is held in a state where the end portion of the continuous medium is held (nipped). Thus, the second roller pair can nip the region other than the region of the continuous medium where the image is formed, reduce the contact between the second roller pair and the image formed on the continuous medium, and the image quality can be maintained. In addition, since the second roller pair nips one end portion in the conveying direction of the continuous medium, the user can easily pull out the sheet in the conveying direction without loading from the second roller pair.

What is claimed is:

1. A printing apparatus comprising:

a first roller pair configured to sandwich and convey a continuous medium;

a printing head that is located downstream of the first roller pair in a conveying direction of the continuous medium and that is configured to perform printing on the continuous medium;

a cutting unit that is located downstream of the printing head in the conveying direction of the continuous medium and that is configured to cut the continuous medium;

a second roller pair that is located downstream of the cutting unit in the conveying direction of the continuous medium and that is configured to sandwich and convey the continuous medium;

a common driving source configured to apply driving force to the first roller pair and the second roller pair; and a clutch mechanism configured to cut power from the driving source to the second roller pair, wherein the clutch mechanism is an electromagnetic mechanism that releases transmission of the power by electromagnetism.

2. The printing apparatus according to claim 1, further comprising:

a medium detector that is located between the first roller pair and the printing head and that is configured to detect presence or absence of the continuous medium; and a control unit that is configured to, after the continuous medium is cut, convey, in a reverse direction, the continuous medium located at a supply side, and that is configured to, after an end portion at the downstream side of the continuous medium is detected by the medium detector, convey the continuous medium in a forward direction and temporarily stop the continuous medium at a predetermined position, wherein the control unit controls the clutch mechanism to, when the continuous medium is conveyed in the reverse direction, cut the power from the driving source to the second roller pair and, when the continuous medium is conveyed in the forward direction after being temporarily stopped at the predetermined position, couple the power from the driving source to the second roller pair, and then, when a distance between the second roller pair and an end portion at the upstream side in the conveying direction of the continuous medium that is sandwiched by the second roller pair is 2 mm±1 mm, cut the power from the driving source to the second roller pair.

* * * * *